US006446556B1

(12) United States Patent
Ida

(10) Patent No.: US 6,446,556 B1
(45) Date of Patent: Sep. 10, 2002

(54) PRINTER AND A METHOD OF CONTROLLING THE PRINTER

(75) Inventor: Koji Ida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/499,329

(22) Filed: Feb. 4, 2000

(30) Foreign Application Priority Data

Feb. 4, 1999 (JP) ..... 11-027391

(51) Int. Cl.[7] ..... B41F 1/54
(52) U.S. Cl. ..... 101/484; 101/485; 358/412
(58) Field of Search ..... 101/216, 484, 101/485; 400/556, 567, 568, 569; 358/412, 419, 420, 421, 422

(56) References Cited

U.S. PATENT DOCUMENTS 4,908,652 A * 3/1990 Hayakawa et al. ..... 355/133
5,524,994 A * 6/1996 Hirano et al. ..... 271/245
5,594,486 A * 1/1997 Kiyohara ..... 271/274
6,026,723 A * 2/2000 Sakai ..... 226/143
6,178,863 B1 * 1/2001 Kobayashi et al. ..... 83/649
6,333,796 B1 * 12/2001 Isozaki ..... 358/496

* cited by examiner

*Primary Examiner*—Ren Yan
(74) *Attorney, Agent, or Firm*—Akin, Gump. Strauss, Hauer & Feld, L.L.P.

(57) ABSTRACT

A printer has a printing mechanism and a drive mechanism that drives the printing mechanism. The printing mechanism including a charging unit, a exposing unit, a photoconductive drum, a developing unit, and transfer unit. The drive mechanism includes a planetary gear that is selectively positioned depending on a direction of rotation thereof. The printer comprises a memory and a controller. The memory stores a first position of the planetary gear at which the planetary gear stops rotating. The controller determines a second position to which the planetary gear should be positioned when the planetary gear starts rotating after stoppage. The second position is determined depending on the direction of rotation in which the planetary gear starts rotating. The controller controls a timing at which a voltage is applied to the printing mechanism, the timing being determined in accordance with the first position and the second position. The timing includes a first timing and a second timing which lagging behind the first timing. The controller applies the voltage to the printing mechanism at the first timing if the second position is the same as the first position, and at the second timing if the second position is different from the first position.

16 Claims, 9 Drawing Sheets

PRINTER AND A METHOD OF CONTROLLING THE PRINTER

BACKGROUND OF THE INVENTION

1. Field of the Invention

The present invention generally relates to a printer such as an electrophotographic printer in which a planetary gear for driving a printing mechanism is switched between two positions depending on the direction of rotation thereof. The present invention also relates to a method of controlling such a printer.

2. Description of the Related Art

FIG. 10 illustrates a conventional printer.

Referring to FIG. 10, a charging roller 12 rotates in contact with a photoconductive drum 11. The charging roller 12 receives a negative voltage from a charging power supply 10 and charges the surface of the photoconductive drum 11 to a negative potential of about −800 V. White circles on the photoconductive drum 11 indicate negative charges. A light source 13 in the form of, for example, an LED head illuminates the charged surface of the photoconductive drum 11 to form an electrostatic latent image on the surface. A developing unit 14 has a roller unit 15 consisting of a plurality of rollers. The developing unit 14 supplies negatively charged toner to the electrostatic latent image formed on the photoconductive drum 11 to develop the electrostatic latent image into a toner image. Black circles indicate toner particles. A transfer roller 19 rotates in contact with the photoconductive drum 11 and receives a positive voltage from a transfer power supply 18, thereby transferring the toner image formed on the photoconductive drum 11 to print paper 16. A cleaning unit 17 removes residual toner that failed to be transferred to the print paper 16 and was left on the photoconductive drum 11 after the transfer operation. A fixing unit 23 includes a heat roller 23*a* and a pressure roller 23*b*, so that when the print paper is pulled in between the heat roller 23*a* and pressure roller 23*b*, the toner image on the print paper 16 is fused. The heat roller 23*a* and the pressure roller 23*b* discharge the print paper 16 to the outside of the printer.

When the toner image is being formed on the photoconductive drum 11, the print paper 16 is fed from a paper tray 20. A feed roller 21 feeds the top page of a stack of print paper held in the paper tray 20 to the transfer point between the photoconductive drum 11 and the transfer roller 19. The pages of print paper are fed on a sheet-by-sheet basis. The print paper passes through a transport path in which a pair of registry rollers 22*a* and 22*b* is disposed.

The rollers of associated mechanisms are driven by the same motor via a plurality of gears. While some of these rollers may be driven to rotate and stop at the same timing, others may have to be controlled independently.

Immediately before a printing operation, a warm-up operation is performed in order to ensure stable printing operation. During the warm-up operation, the print paper should not be advanced and therefore if the print paper is to be fed from the paper tray 20, the feed roller 21 is prevented from rotating during the warm-up operation. Thus, the feed roller 21 must be controlled independently of the other rollers.

When the print paper is fed from the paper tray 20, the registry rollers 22*a* and 22*b* may be rotated and stopped at the same timing as the other rollers. However, when the user feeds the print paper 16 manually from the front side of the printer, the controller is unable to know the timing at which the print paper is actually fed. Thus, it is required that a paper sensor 24 accurately detects the position of the print paper so that the registry rollers 22*a* and 22*b* are driven into rotation at a proper timing independent of the other rollers. The print paper is accurately fed in this manner so that the printing is initiated at a specified location on the print paper.

As described above, if the rollers are necessary to be driven independently, they are usually driven by separate motors. However, small size, low price printers should be equipped with a minimum number of motors. Therefore, a desirable printing mechanism uses a planetary gear mechanism.

FIG. 11 illustrates a gear train used in a small printer and driven by a single motor, showing the meshing engagement among the gears during the warm-up operation.

The gear train is featured by a planetary gear 25*g*. The planetary gear 25*g* is in mesh with a gear 27*g* which in turn is in mesh with a gear 26*g* of a motor 26. The planetary gear 25*g* rotates in the same direction as the motor 26. The planetary gear 25*g* is movable about the gear 27*g* so that the position of the planetary gear 25*g* may be switched between two positions depending on the rotational direction of the planetary gear 25*g*.

The operations of the gears during the warm-up operation will be described with respect to FIG. 11.

During the warm-up operation, the motor 26 drives the motor gear 26*g* in rotation in a direction shown by arrow A1. Thus, the planetary gear 25*g* rotates in a direction shown by arrow A2 so that the position of the planetary gear 25*g* is switched in a direction shown by arrow A3. The planetary gear 25*g* drives an idle gea[00f8] 28*g* in rotation. Then, the idle gear 28*g* drives a triple gear 29*g*, which in turn drives a transfer roller gear 19*g* and a fixing roller gear 30*g*. The transfer roller gear 19*g* is mounted to the transfer roller 19 and drives the transfer roller 19 in rotation. The transfer roller gear 19*g* also drives the photoconductive drum 11, not shown, in rotation. The photoconductive drum 11 has another gear that drives other associated rollers such as the charging roller 12 and developing roller 15. A gear 30*g* drives rollers 23*a* and 23*b* of the fixing unit 23 in rotation.

In FIG. 11, the gear 31*g* is not in mesh with the planetary gear 25*g*, so that no drive force is transmitted to the feed roller gear 21*g*, gear 32*g*, and registry roller gear 22*g*. Thus, the print paper is not fed.

FIG. 12 illustrates the gear train during the printing operation. During the printing operation, the motor 26 rotates in a reverse direction, driving the motor gear 26*g* to rotate in a direction shown by arrow B1. Thus, the planetary gear 25*g* rotates in a direction shown by arrow B2, the position of the planetary gear 25*g* being switched in a direction shown by arrow B3. Then, the planetary gear 25*g* is brought into meshing engagement with the triple gear 29*g* and gear 31*g*, thereby driving the triple gear 29*g* and gear 31*g* in rotation.

The gear 31*g* drives the feed roller gear 21*g*. The feed roller gear 21*g* is operatively connected to the feed roller 21 through a clutch, not shown, so that the feed roller gear 21*g* drives the clutch to engage and disengage in accordance with a signal from a printer controller. The rotation of the feed roller gear 21*g* is transmitted through the gear 32*g* to the registry roller gear 22*g* so that the registry roller 22*g* causes the print paper to advance.

As mentioned above, the motor gear 26*g* is rotated in the direction shown by arrow B1 during the printing operation, rollers associated with the printing operation, rollers associated with fixing operation, and registry rollers are simultaneously rotated. The clutch is controlled by the signal from the printer controller, thereby causing the feed roller 21*g* to rotate and stop as required.

As described above, the conventional printer is designed to reverse the direction of rotation of the motor 26 depending on whether the print paper 16 should be fed and should not be fed. Then, the planetary gear 25*g* was used to control the transmission of the drive force of the motor 26.

In the manual feed mode, the user inserts the print paper from the front side of the printer. However, the printer controller does not know the timing at which the user inserts the print paper. Therefore, the warm-up operation cannot be performed immediately before the transport of the print paper. In other words, when the print paper is manually fed, the transport of the print paper should be halted as soon as the leading end of the print paper has been positioned just past the registry rollers 22*a* and 22*b*, and then the warm-up operation is performed before entering the printing operation.

As described above, with the printer of FIG. 11, when the print paper is manually fed, the registry rollers 22*a* and 22*b* are used to set the print paper at a predetermined position. The registry rollers 22*a* and 22*b* are rotated only when the motor 26 rotates in the direction shown by arrow B1.

Thus, when the print paper is inserted into the manual feed tray, not shown, the print controller receives a detection signal from the manual feed sensor 24 and causes the motor 26 to rotate in the direction of the arrow B1 as shown in FIG. 12. The print paper placed on the manual feed tray is pulled in between the registry rollers 22*a* and 22*b*. Before the leading end of the print paper reaches the transfer point (contact area) defined between the photoconductive drum 11 and the transfer roller 19, the motor 26 is stopped so that the print paper is held where it is. Then, as shown in FIG. 11, the motor 26 is rotated in the direction shown by arrow A1, thereby performing the warm-up operation just before the printing. Since the motor 26 rotates in the reverse direction, the planetary gear 25*g* is caused to move in the direction shown by arrow A3, so that the registry rollers 22*a* and 22*b* receive no drive force and therefore the print paper remains held in the transport path.

FIGS. 13 and 14 are timing charts, illustrating timings at which a high voltage is applied to the photoconductive drum 11 when the motor 26 and photoconductive drum 11 reach specific rotational speeds.

If the motor 26 is to begin to rotate in the same direction in which the motor 26 rotated just before the motor 26 stopped, then the planetary gear 25*g* remains at the same position. In other words, the planetary gear 25*g* begins to rotate from where it stopped. Thus, as shown in FIG. 13, the planetary gear 25*g* causes the gear in mesh with it to rotate simultaneously with the motor 26 begins to rotate.

However, as shown in FIG. 14, if the motor 26 is to rotate in a direction opposite to the direction in which the motor 26 was rotating before the motor 26 stopped, a time should be allowed for the planetary gear 25*g* to be switched from one position to the other. That is, it takes a length of time for the planetary gear 25*g* to properly mesh with another gear (e.g., from the gear 31*g* of FIG. 12 to the idle gear 28*g* of FIG. 11 during the warm-up operation). Thus, the photoconductive drum 11 and rollers start rotating a short time after the motor 26 has started rotating. Therefore, if a high voltage is applied to the photoconductive drum 11 at the same time that the motor 26 starts rotating, the photoconductive drum 11 receives the high voltage while it is still stationary. As a result, the photoconductive drum 11 may be damaged.

Moreover, when the planetary gear 25*g* has been brought into meshing engagement with associated gears, the motor 26 is still being accelerated or may have reached a high speed. Thus, the planetary gear 25*g* is also rotating at high speed. The planetary gear 25*g* rotating at high speed is suddenly brought into meshing engagement with the stationary mating gear, large loads being suddenly exerted on the planetary gear 25*g* and the stationary mating gear so that the motor 26 and gears may be subjected to mechanical damages.

If the surface of the photoconductive drum 11 is damaged such that the surface is not properly charged to about −800 V but to, for example, nearly 0 V, the toner is deposited thereto even though no image is actually formed in accordance with print data. This causes deteriorated print quality. Toner deposited on the photoconductive drum 11 forms black lines on the print paper, resulting in poor print quality.

Moreover, if the charging roller 12 and other rollers start rotating with no voltage applied to the charging roller 12, the toner between the charging roller 12 and the photoconductive drum 11 may migrate to the photoconductive drum 11, resulting in lateral lines on the printed image. Such a phenomenon also occurs between the developing roller 15 and the photoconductive drum 11 and between the transfer roller 19 and the photoconductive drum 11.

When a printing is performed in the manual feed mode, the warm-up operation is performed with the print paper not advanced. The printing is then started after the rotational direction of the motor 26 is switched. Thus, if the photoconductive drum 11 is contaminated with toner, the contamination causes soiling of print paper in most cases.

SUMMARY OF THE INVENTION

The present invention was made in view of the aforementioned problems.

An object of the invention is to provide a printer where when a drive force is transmitted through a planetary gear to associated gears in accordance with the rotational direction of a motor, voltages are applied at controlled timings and the motor rotates at a controlled speed.

A method of controlling is used to controllably drive a printing mechanism by using a planetary gear that is selectively positioned depending on a direction of rotation thereof. The method includes the steps of:

storing a first position of the planetary gear when the planetary gear is not rotating;

determining a second position to which the planetary gear should be positioned when the planetary gear starts rotating after stoppage, the second position being determined depending on the direction of rotation in which the planetary gear starts rotating;

changing a timing at which a high voltage is applied to an associated section for a printing operation, the timing being determined in accordance with the second position.

A printer has a printing mechanism and a drive mechanism that drives the printing mechanism. The printing mechanism includes a charging unit, an exposing unit, a photoconductive drum, a developing unit, and a transfer unit. The drive mechanism includes a planetary gear that is selectively positioned depending on a direction of rotation thereon. The printer comprises a memory and a controller. The memory stores a first position of the planetary gear at which the planetary gear stopped rotating. The controller determines a second position to which the planetary gear should be positioned when the planetary gear starts rotating after stoppage. The second position is determined depending on the direction of rotation in which the planetary gear starts rotating. The controller controls a timing at which a voltage is applied to the printing mechanism, the timing being determined in accordance with the first position and the second position. The controller applies the voltage to the printing mechanism at a first timing if the second position is the same as the first position, and at a second timing if the second position is different. from the first position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

<Construction>

Figure 10:
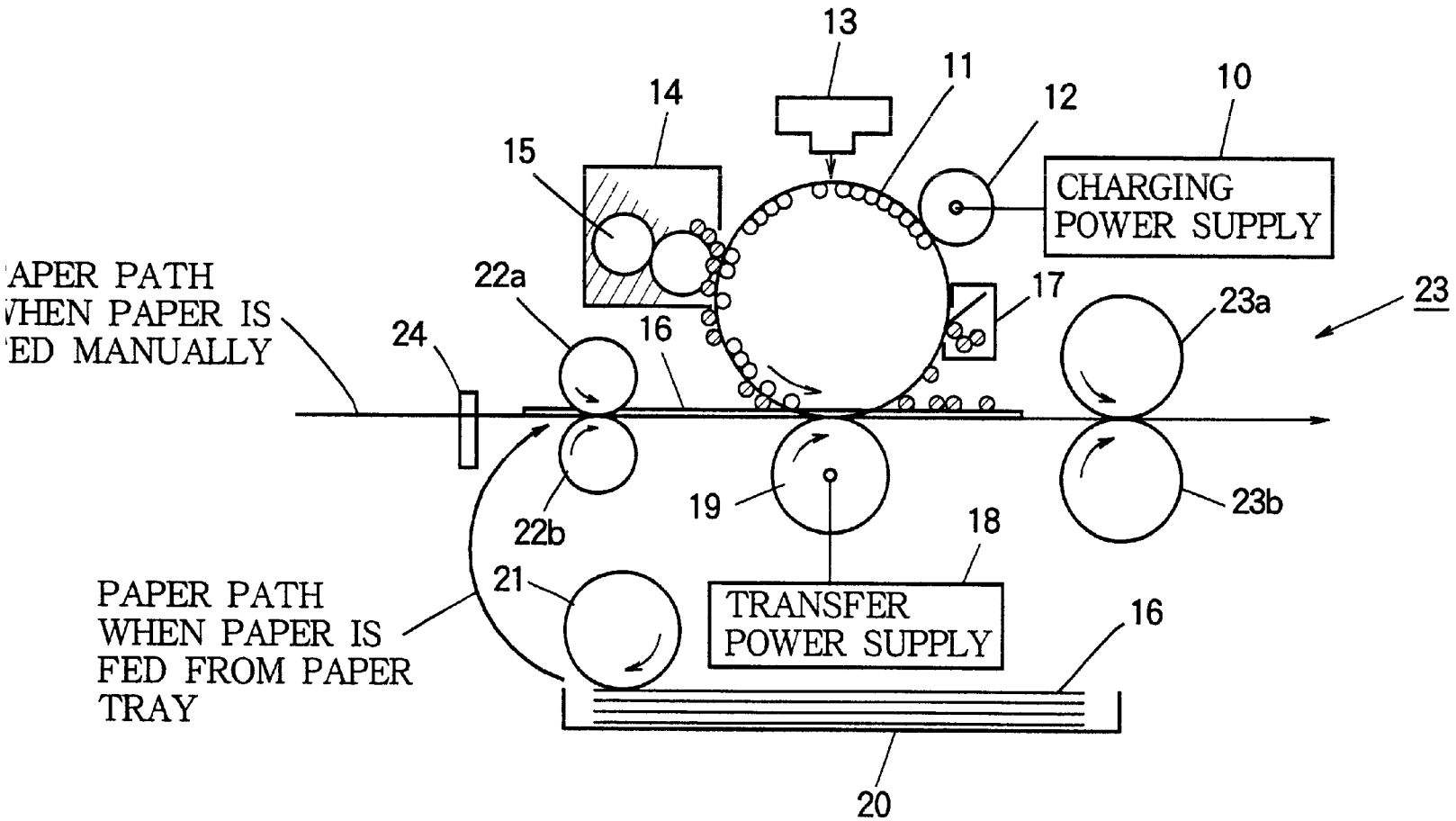
FIG.10 PRIOR ART
FIG. 10 illustrates a small printer.

A first embodiment is characterized in that a printer controller has a memory that stores the rotational direction of the planetary gear (or positions of the planetary gear) and the rotational direction is used to properly control the timings at which high voltages are applied to the associated rollers. The rest of the construction is the same as the aforementioned conventional printer. While the photoconductive drum shown in FIG. 10 has been described as being charged to a negative high voltage, the photoconductive drum may also be charged to a positive high voltage, in which case rollers such as charging roller, developing rollers, transfer rollers, cleaning roller (blade) are supplied with voltages of appropriate polarities.

Figure 1:
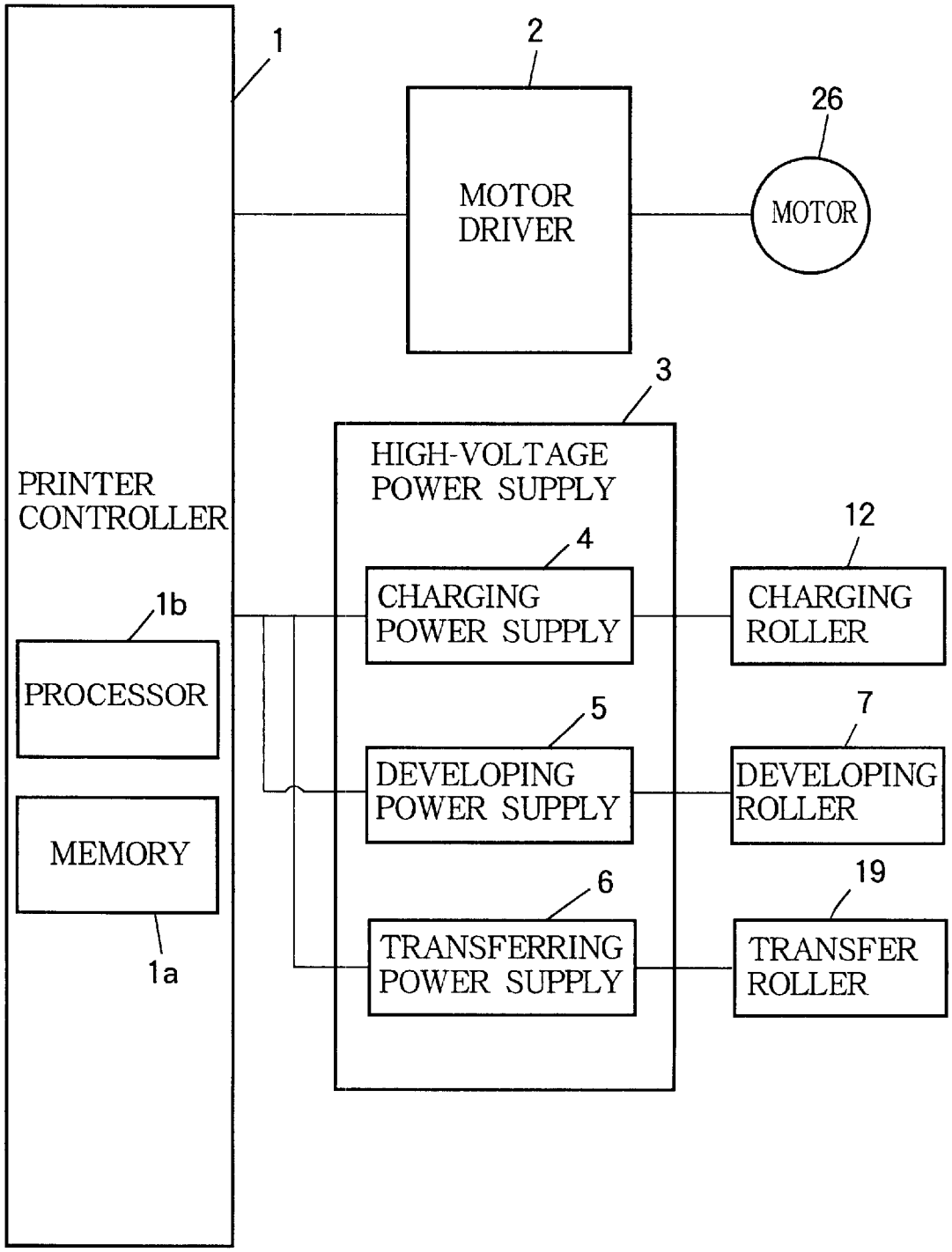
FIG. 1 is a block diagram illustrating the controls of the printer and high voltages in the first embodiment.

FIG. 1 is a block diagram illustrating the controls of the printer and high voltages in the first embodiment.

Referring to FIG. 1, a printer controller 1 includes a memory 1*a* and a processor 1*b*. The memory 1*a* stores the rotational direction of a motor 26. A motor driver 2 is connected to the motor 26. The processor 1*b* controls the rotation and stoppage of the motor 26 and timings at which high voltages are applied to the associated rollers.

Figure 11:
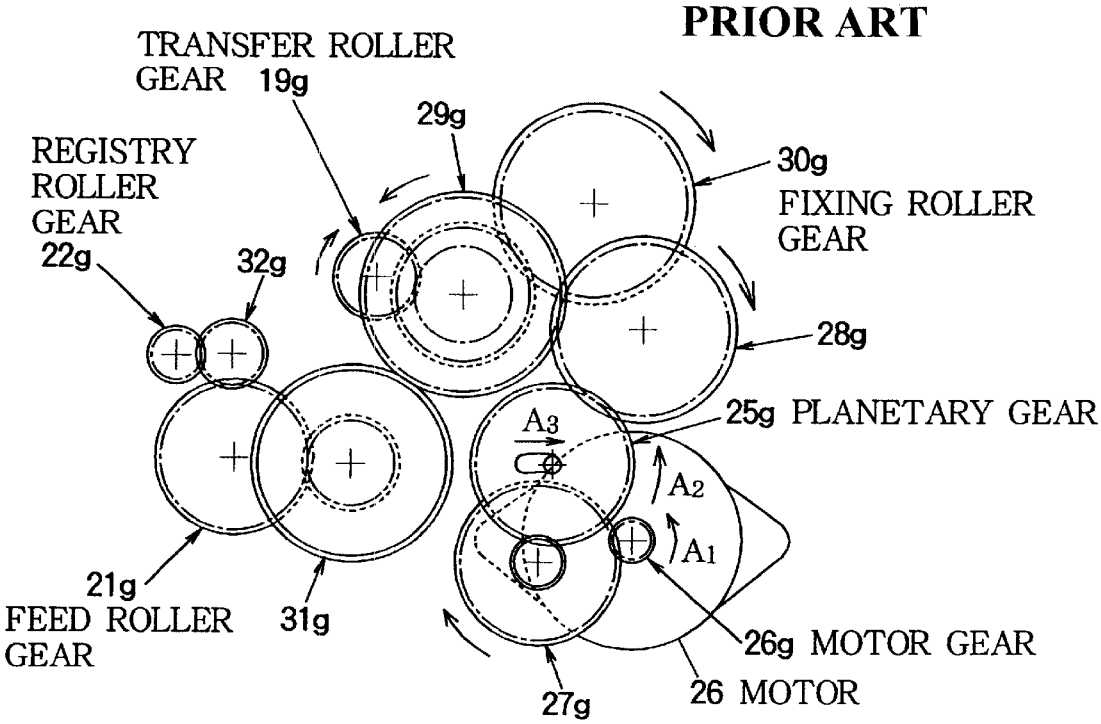
FIG.11 PRIOR ART
FIG. 11 illustrates a gear train in the small printer of FIG. 10, driven by a single motor.

The printer controller 1 is connected to a high voltage power supply 3 that includes constant-voltage power supplies 4–6. The power supplies 4–6 provide voltages to a charging roller 12, a developing roller 7, and a transfer roller 19, respectively. The motor 26 takes the form of a stepping motor and the mechanical structure of the printer is the same as that of the electrophotographic printer shown in FIGS. 10–12.

The motor 26, which is a drive source for the printer, is controlled as follows: The printer controller 1 provides a phase signal to the motor driver 2 which in turn supplies current to the motor 26 in accordance with the phase signal, thereby controlling the start of rotation, acceleration of rotation, deceleration of rotation, stoppage, and reverse rotation etc. of the motor 26.

These controls of the motor 26 are the same as those of a stepping motor used in the conventional printer.

The printer controller 1 provides control signals to the high voltage power supply 3. The charging power supply 4, developing power supply 5, and transfer power supply 6 are controlled by the control signals to become ON and OFF independently of one another.

The controls of the high voltage power supplies are the same as those performed in ordinary conventional printers.

<Overall Operation>

The overall operation of the printer according to the first embodiment will now be described.

Figure 2:
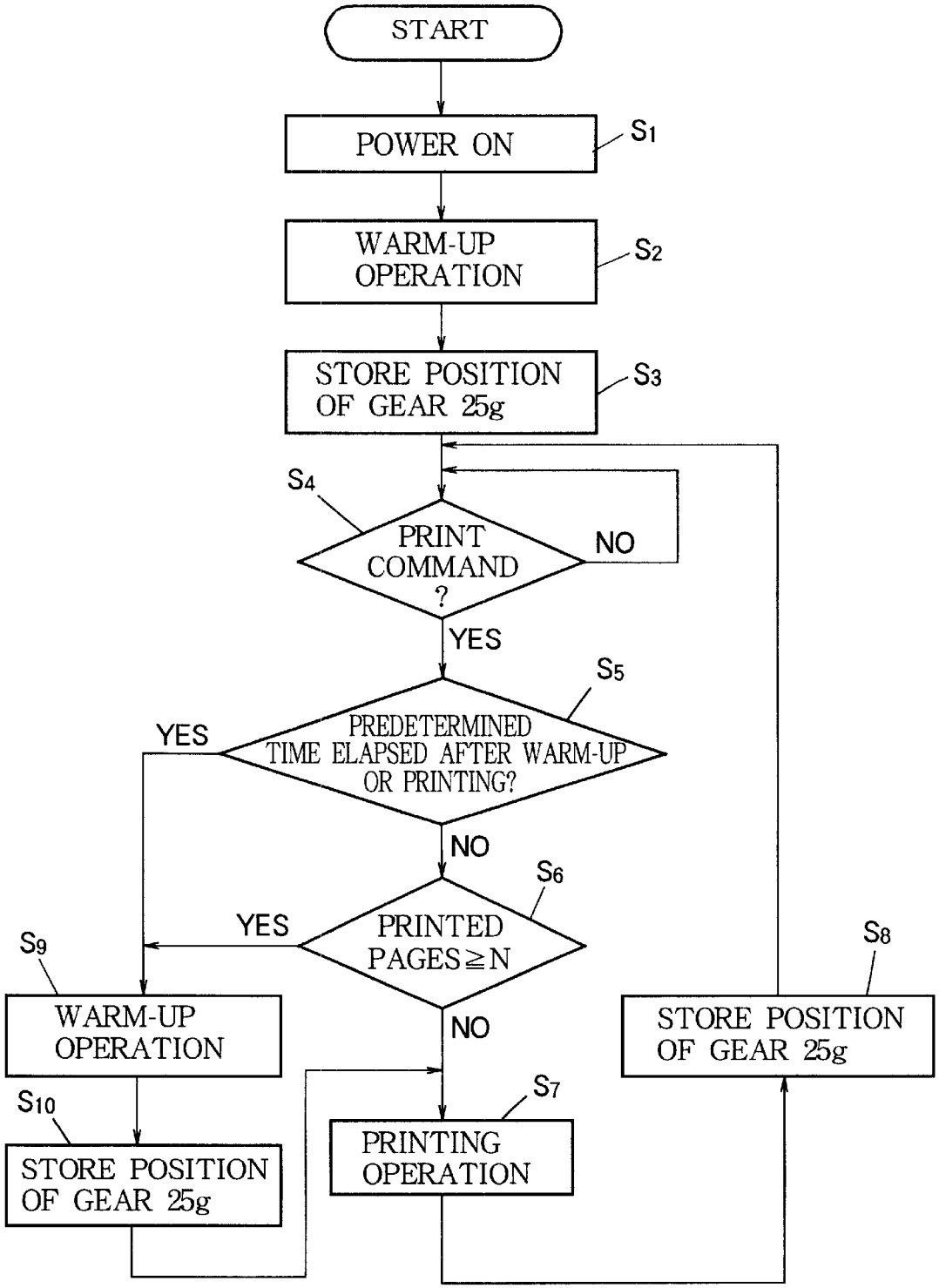
FIG. 2 is a flowchart illustrating the overall operation of the printer.

FIG. 2 is a flowchart illustrating the overall operation of the printer.

The printer is powered on at step S1. After the war-up operation is performed at step S2, the position of the planetary gear 25*g* is stored at step S3. Then, the controller 1 determined at step S4 whether a print command has been received. If the answer is NO at step S4, the program waits until the print command is received. If the answer at step S4 is YES, then the controller determines at step S5 whether a predetermined time has elapsed after the last warm-up operation or the printing. If the answer at step S5 is NO, then the program proceeds to step S6 where the controller 1 determines whether the number of printed pages is equal to or larger than a predetermined number N. If the answer is NO at step S6, then the program proceeds to step S7 where a printing operation is performed. After the printing has been completed, the motor 26 is stopped and the position of the planetary gear 25*g* is stored into the memory 1*a*. If the answer is YES at step S5 or step S6, the program proceeds to step S9 where the warm-up operation is performed and subsequently the position of the planetary gear 25*g* is stored into the memory 1*a*. Then, the program proceeds to step S7.

<Applying High Voltages with and without Delay>

Just before the motor 26 is rotated, the printer controller 1 makes a decision to determine whether the direction in which the motor is to start rotating is the same as that in which the motor was rotating before it stopped. The direction in which the motor 26 is to start rotating determines a target position of the planetary gear at which the planetary gear 25*g* should be positioned. Therefore, instead of the rotational direction of the motor 26, the memory 1*a* may store the position of the planetary gear 25*g* at which the motor 26 is stationary and a target position of the planetary gear 25*g* at which the planetary gear 25*g* is to rotate.

Figure 3:
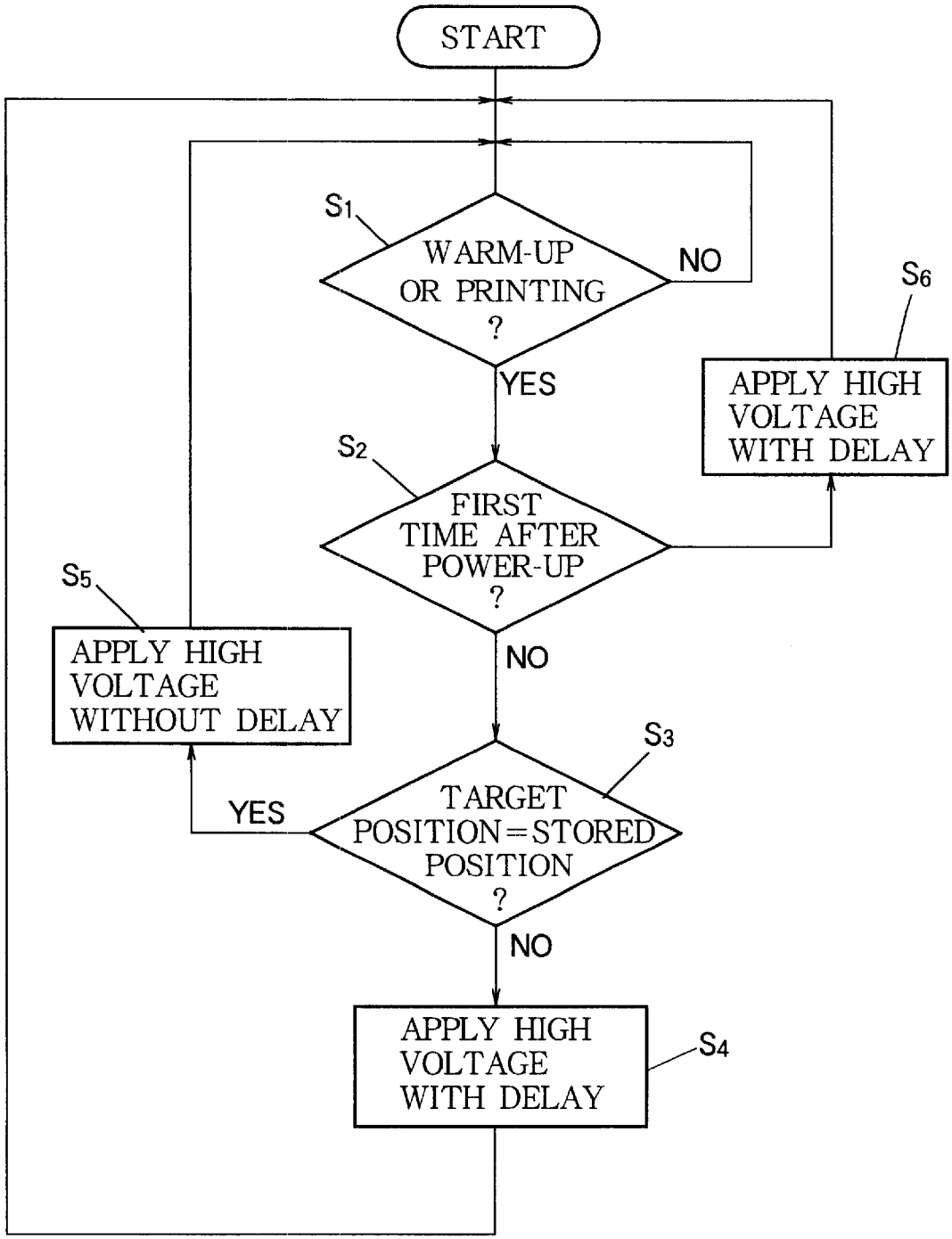
FIG. 3 is a flowchart illustrating the selection of timing at which the high voltages are applied to the associated rollers.

FIG. 3 is a flowchart illustrating the selection of timing at which the high voltages are applied to the associated rollers.

Figure 4:
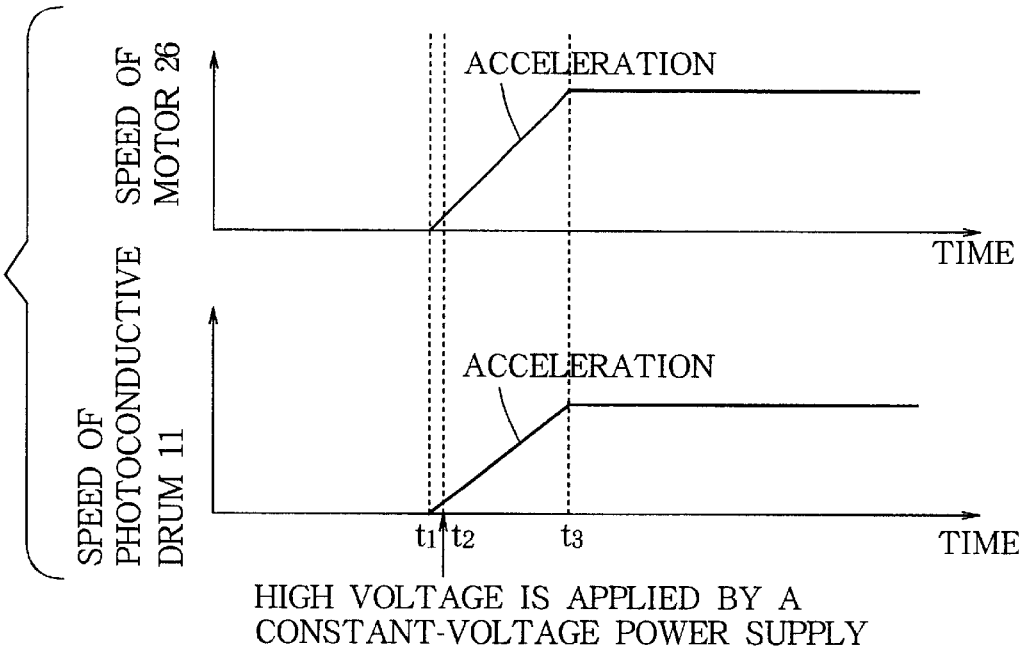
FIG. 4 is a timing chart of the first embodiment when the position of the planetary gear need not be switched.
Figure 5:
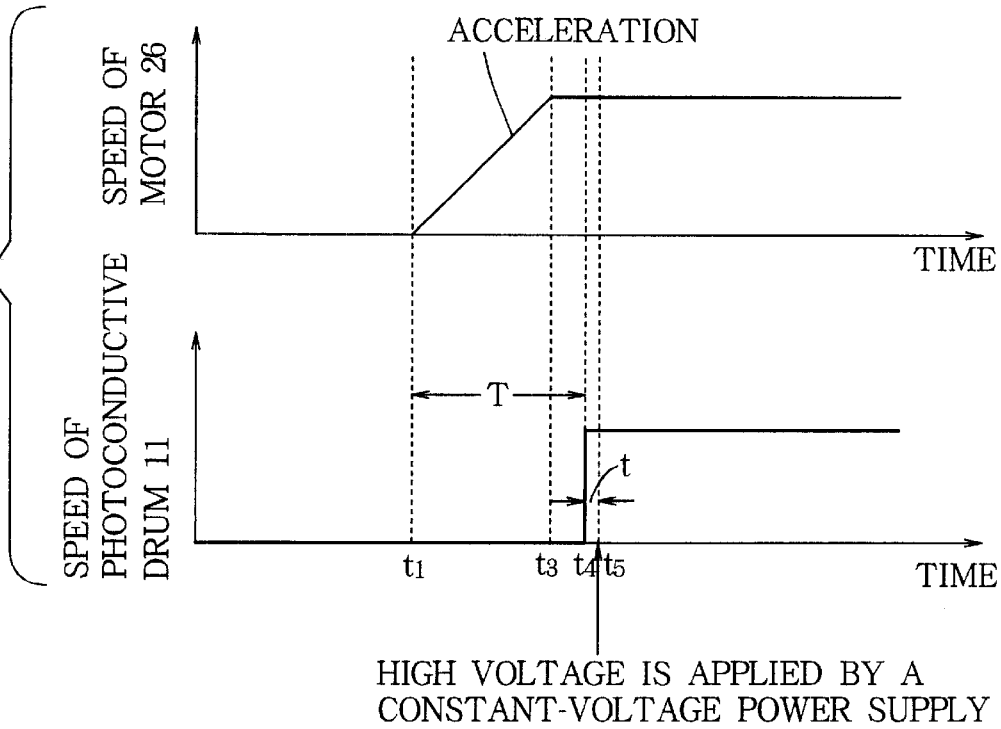
FIG. 5 is a timing chart of the first embodiment when the planetary gear needs to be switched from one position to another.

Upon power-up of the printer, the controller 1 determines at step S1 whether the warm-up operation is activated or the printing operation is activated. If the answer is YES at step S1, then the program proceeds to where the controller 1 determined whether the warm-up operation or the printing operation is performed for the first time after power-up. If the answer at step S2 is NO, then the controller 1 determines whether the target position of the planetary gear 25*g* is the same as the stored position of the planetary gear 25*g*. If the answer at step S3 is NO, then the high voltages are applied to the associated rollers with delay T (FIG. 5). If the answer at step S3 is YES, then the high voltages are applied to the associated rollers without delay (FIG. 4). If the answer at step S2 is YES, then the program jumps back to step S1 where the program waits for a command of the war-up operation or the printing operation.

FIGS. 4 and 5 illustrate the relationships among the rotational speed of the photoconductive drum 11, rotational speed of the motor 26, and timings at which the high voltages are applied to the associated rollers.

FIG. 4 is a timing chart when the position of the planetary gear need not be switched.

There is no need for switching the position of the planetary gear 25*g* if the motor 26 is to start rotating in the same direction as the direction in which the motor was rotating before the motor 26 was stopped. Thus, as shown in FIG. 4, the high voltages can be applied to the associated rollers at the timings immediately after the motor 26 starts rotating. This is because, as described with reference to FIG. 12, if the planetary gear 25*g* has been in meshing engagement with the associated gear, the photoconductive drum 11 and the associated rollers start rotating at the same time that the motor 26 starts rotating. In this manner, the timing at which the high voltage is applied to the photoconductive drum 11 is selected with respect to the timing at which the motor 26 is accelerated, thereby ensuring that the photoconductive drum 11 receives the high voltage only after the photoconductive drum 11 has started rotating.

FIG. 5 is a timing chart when the planetary gear 25*g* needs to be switched from one position to another (i.e., either from the gear 28 to the gears 29*g* and 31*g*, or from the gears 29*g* and 31*g* to the gear 28).

Figure 12:
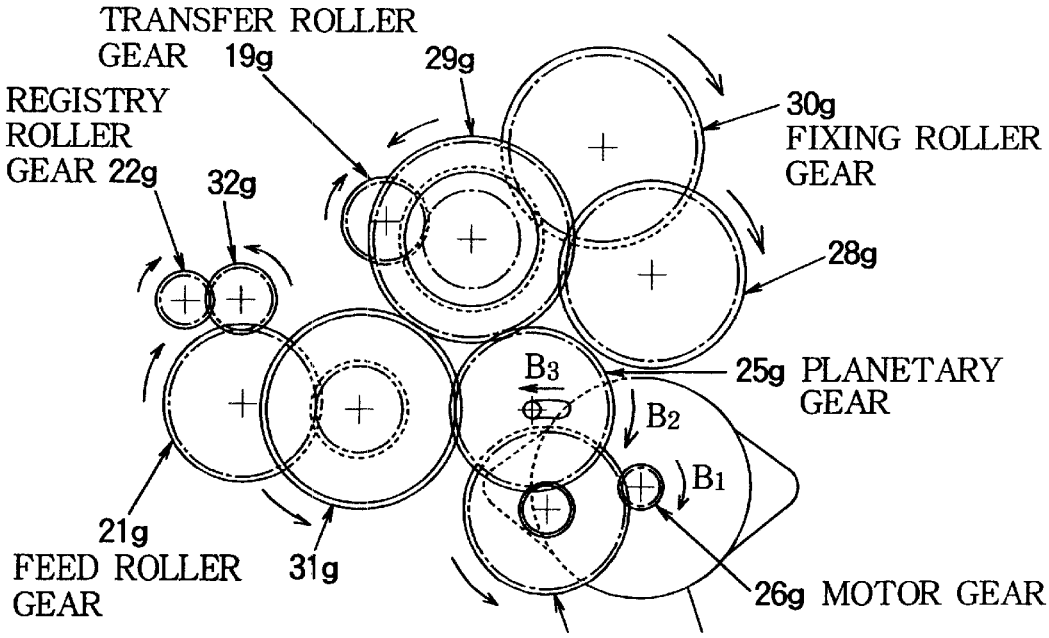
FIG.12 PRIOR ART
FIG. 12 illustrate the gear train in the printer of FIG. 10 driven by a single motor during the printing operation.
Figure 13:
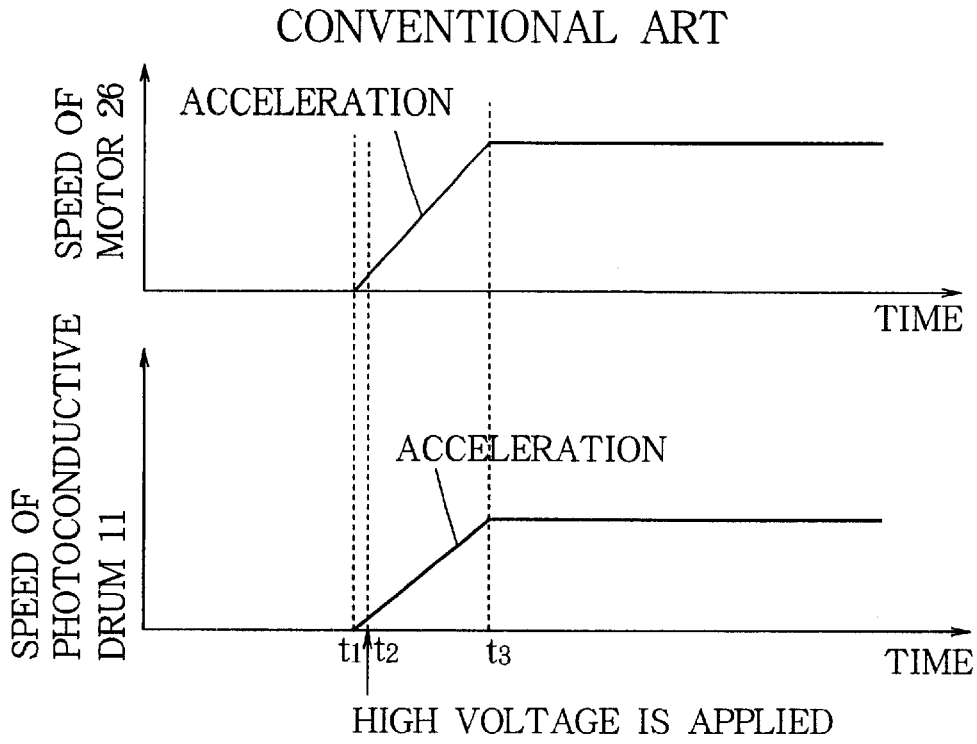
FIGS. 13 and 14 are timing charts of a conventional printer, illustrating timings at which a high voltage is applied to the photoconductive drum 11 at specific rotational speeds of the motor 26 and photoconductive drum 11.
Figure 14:
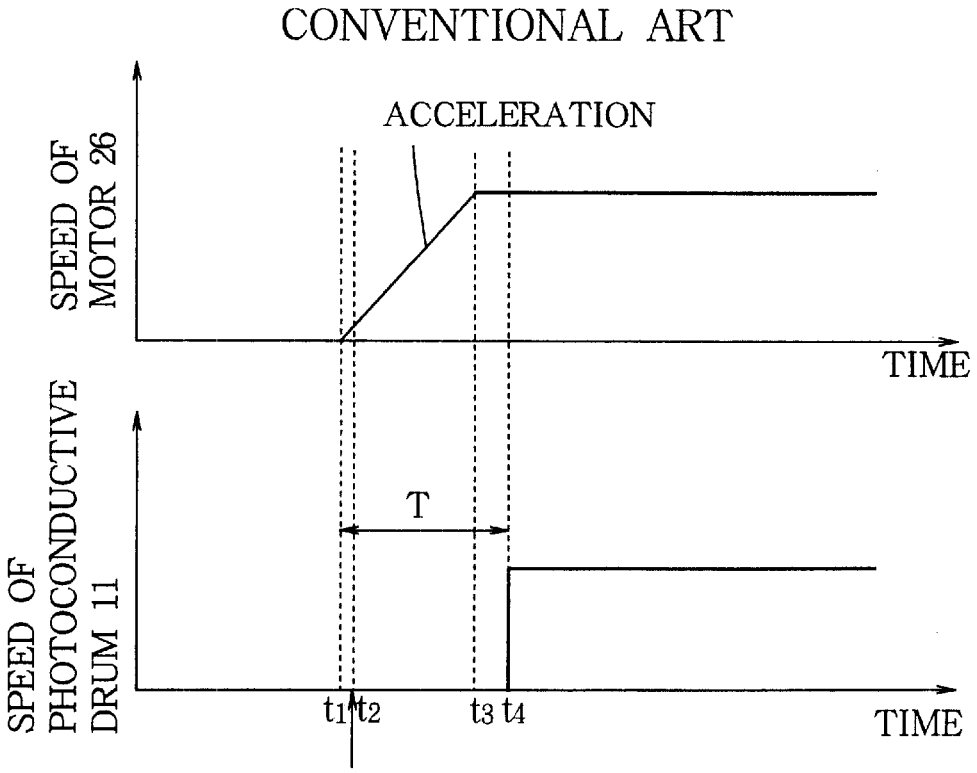

The position of the planetary gear 25*g* is switched if the motor 26 is to start rotating in a direction opposite to the direction in which the motor 26 was rotating before it was stopped. The high voltages should be applied at a timing shown in FIG. 5 after the required switching time T has elapsed. This is because, as shown in FIG. 12, the photoconductive drum 11 and the associated rollers will not rotate until the planetary gear 25*g* has been switched from one position to another and has been in mesh engagement with the associated gear(s). Thus, the printer controller 1 controls the high voltage power supply 3 so that the photoconductive drum 11 receives the high voltage at the timing shown in FIG. 5.

The length of switching time T has some error and a short time period t should be allowed at the end of the switching time T before the high voltage is actually applied to the photoconductive drum. This ensures that the photoconductive drum 11 receives the high voltage only after the photoconductive drum 11 has been brought into rotation.

When the motor 26 is rotated for the first time after the printer is powered on, the memory la of the printer controller 1 has no data that describes the rotational direction of the planetary gear 25*g*, in which case, the print controller 1 assumes that the planetary gear 25*g* will have to be switched from one position to another. Thus, the high voltage can be applied at the timing shown in FIG. 5. This way of initial starting of the printer ensures that the photoconductive drum 11 is protected from being applied the high voltage while it is still stationary.

Second Embodiment

A second embodiment is characterized in that the memory 1*a* stores the rotational direction of the motor (or the position of the planetary gear) and the rotational direction stored in the memory 1*a* is used to set the timings at which the high voltages are applied to the associated rollers, and switch the mode in which the motor 26 is accelerated. In other words, when the planetary gear 25*g* needs to be switched from one position to another, the printer controller 1 generates a phase signal to the motor driver 2, the phase signal requesting the acceleration of rotational speed in, for example, two steps. Thus, the rotational speed of the motor 26 is controlled in accordance with the phase signal. The rest of the construction is the same as the aforementioned conventional printer.

<Operation>

The operation of the second embodiment will be described.

Just as in the first embodiment, when the motor 26 starts rotating, the rotational direction (or the position of the planetary gear 25*g*) is stored into the memory 1*a* of the printer controller 1. When the motor 26 starts rotating next time, the printer controller 1 reads the rotational direction from the memory 1*a* and determines whether or not the motor 26 is to rotate in the same direction that the motor was rotating before the motor 26 stopped.

Figure 6:
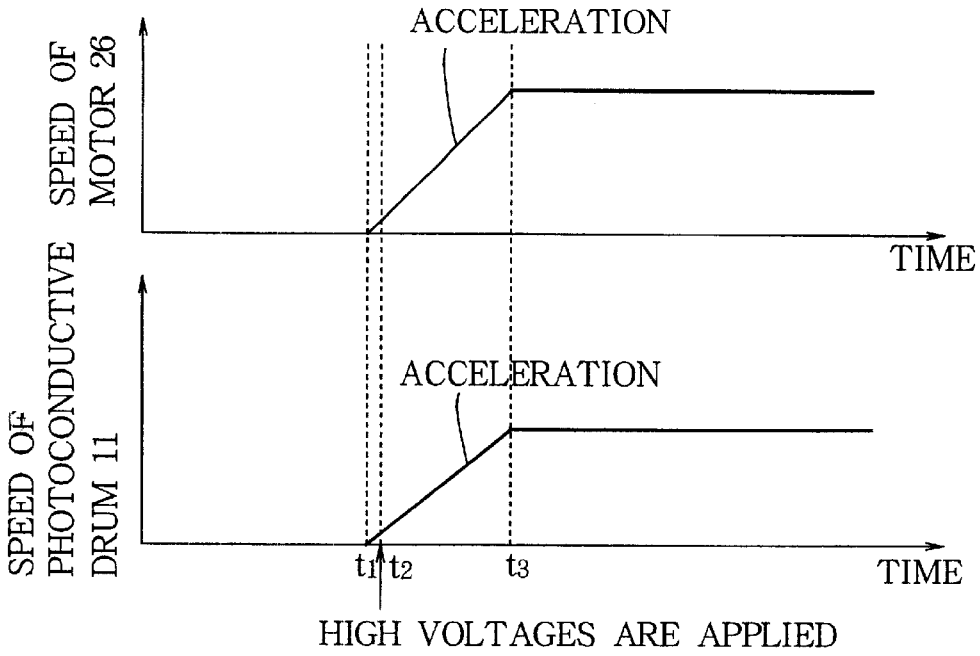
FIGS. 6 and 7 illustrate the relationships among the rotational speed of the photoconductive drum, the rotational speed of the motor, and timings at which the high voltages are applied in the second embodiment, FIG. 6 being a timing chart when the position of the planetary gear need not be switched and FIG. 7 being a timing chart when the position of the planetary gear needs to be switched.
Figure 7:
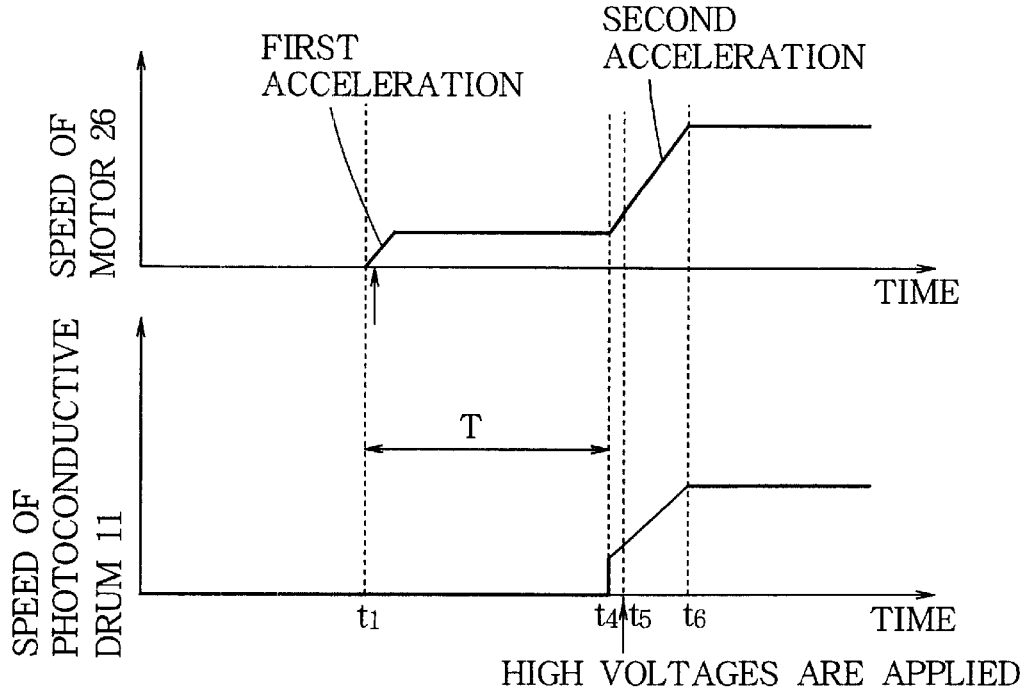

FIGS. 6 and 7 illustrate the relationships among the rotational speed of the photoconductive drum 11, the rotational speed of the motor 26, and timings at which the high voltages are applied. The timings at which the high voltages are applied to the associated rollers are controlled also in the second embodiment. The following description is primarily focused on the operation for controlling the rotational speed of the motor 26, different from the first embodiment.

FIG. 6 is a timing chart when the position of the planetary gear 25*g* need not be switched. As shown in FIG. 6 if the motor 26 starts rotating in the same direction that the motor 26 was rotating before the motor 26 stopped, then the position of the planetary gear 25*g* need not be switched and the photoconductive drum 11 also starts rotating at the same time as the motor 26. Then, the high voltages are applied at time t2 to the associated rollers just as in the first embodiment and the conventional printer.

FIG. 7 is a timing chart when the position of the planetary gear 25*g* needs to be switched. If the motor 26 is to start rotating in a direction opposite to the direction in which the motor 26 was rotating before the motor 26 stopped, then the position of the planetary gear 25*g* needs to be switched. Thus, the high voltages should be applied at a time t5 shown in FIG. 7 in accordance with the required switching time T. Moreover, the rotational speed of the motor 26 remains low until the switching time T has elapsed. This is to prevent large loads from being suddenly applied to the associated gears, thereby protecting the motor 26 and gears from damages.

After the planetary gear 25*g* has been brought into meshing engagement with the mating gear (gear 28*g*,or gears 29*g* and 31*g*), the motor 26 is again accelerated at time t4 toward a target speed for printing. The high voltages are applied at time t5 to the associated rollers at timings just as in the first embodiment, that is, immediately after the planetary gear 25*g* has been switched from one position to another so that the planetary gear 25*g* has moved into complete meshing engagement with the associated gear and the photoconductive drum 11 and other rollers have begun to rotate.

When the motor 26 is rotated for the first time after power-up, the memory la of the printer controller 1 has no data that describes the rotational direction of the planetary gear 25*g*,in which case, the print controller 1 assumes that the planetary gear 25*g* will have to be switched from one position to another. Thus;, the high voltages can be applied at the time t5 shown in FIG. 7.

The second embodiment offers the following advantages in addition to those obtained in the first embodiment.

When the motor 26 is to rotate in a direction opposite to the direction in which the motor 26 was rotating before the motor 26 stopped, the motor 26 is first rotated at the low speed so that the planetary gear 25*g* can be brought into meshing engagement with the associated gear while the planetary gear 25*g* is rotating at the low speed. This way of controlling the speed of the motor 26 reduces loads exerted on the gears and the motor 26, preventing damages to the gears and step-out of the motor 26. Thus, mechanical strength of the gears and torque of the motor 26 may be relatively small, implementing an inexpensive printer.

Third Embodiment

The high voltage power supply 3 of the first and second embodiments is in the form of a constant-voltage power supply. The output voltages of the power supplies 4–6 of the high voltage power supply 3 are set to predetermined values such that the power supplies 4–6 operate as an optimum power supply when the photoconductive drum 11 is rotating at a printing speed.

The printer according to a third embodiment is characterized in that a constant-current high voltage power supply is used in place of the constant-voltage power supply 3 and the high voltages are applied to the associated rollers at timings lagged behind or delayed with respect to those at which the constant voltages are applied. The controls of rotation of the motor 26 and application of high voltages in the third embodiment are the same as those of the first embodiment illustrated in FIG. 1.

Figure 8:
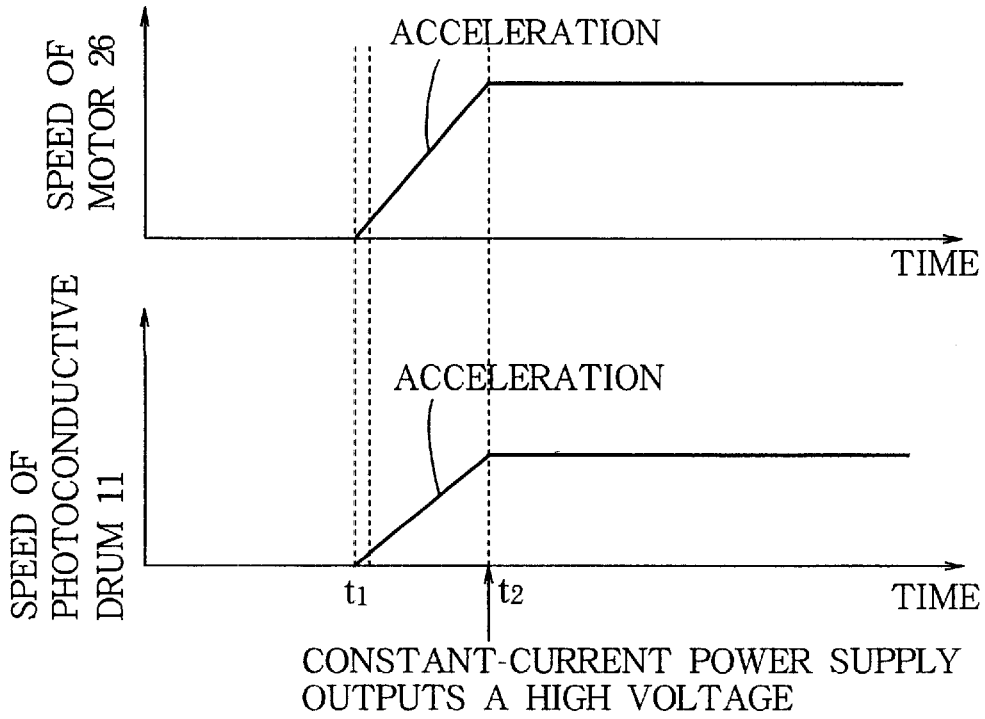
FIGS. 8 and 9 illustrate the relationships among the rotational speed of the photoconductive drum, the rotational speed of the motor, and timings at which the high voltages are applied in the third embodiment, FIG. 8 being a timing chart when the position of the planetary gear need not be switched and FIG. 9 being a timing chart when the position of the planetary gear needs to be switched.
Figure 9:
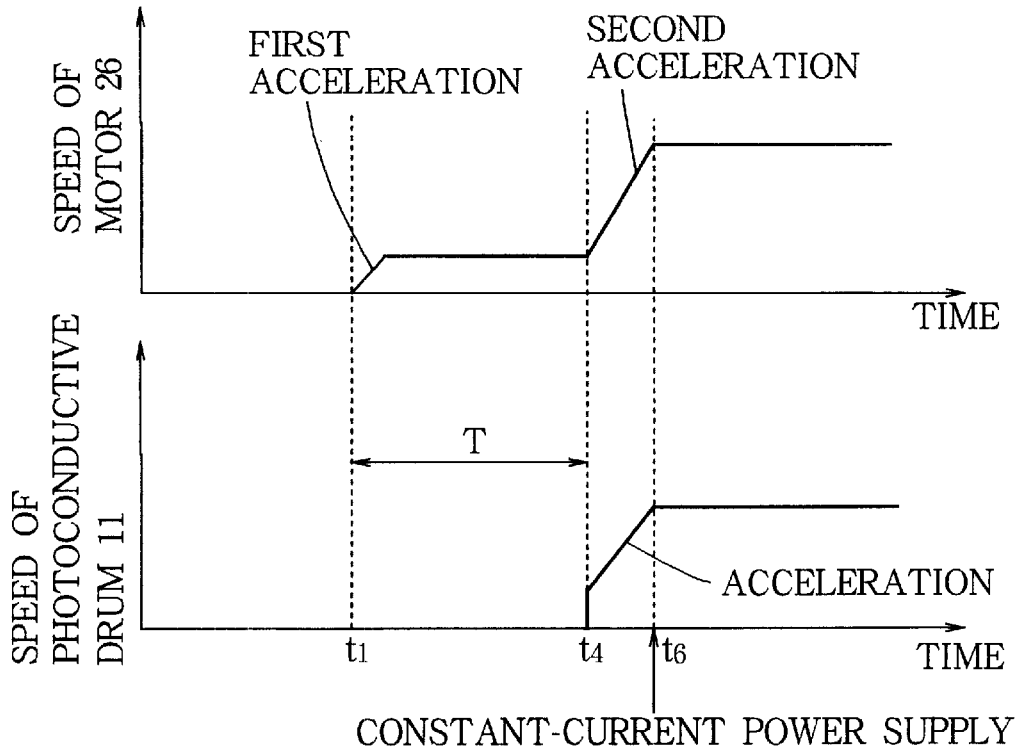

FIGS. 8 and 9 illustrate the relationships among the rotational speed of the photoconductive drum 11, the rotational speed of the motor 26, and timings at which the high voltages are applied, FIG. 8 being a timing chart when the position of the planetary gear 25*g* need not be switched and FIG. 9 being a timing chart when the position of the planetary gear 25*g* needs to be switched.

<Operation>

The operation of the third embodiment will be described.

With a constant-current power supply, a transfer point becomes a heavy load when the photoconductive drum 11 rotates at low speed, therefore the output voltage of the constant-current power supply increases in order to run constant current through the load. Thus, the photoconductive drum 11 can be damaged by the high voltage.

For this reason, as shown in FIGS. 8 and 9, the high output voltage of the constant-current power supply is applied to the associated rollers and photoconductive drum 11 at a timing at which the motor 26 has reached the constant printing speed.

In other words, as shown in FIG. 8, if the position of the planetary gear 25*g* is not required to be switched, the photoconductive drum 11 reaches the printing speed when the motor 26 has reached a constant speed at time t2. Thus, the constant-current power supply is turned on when the motor 26 has reached the constant speed.

Also, if the position of the planetary gear 25*g* is required to be switched, the photoconductive drum 11 reaches the printing speed when the motor 26 has reached a constant speed after the second acceleration. Thus, the constant-current power supply is turned on at time t6 when the motor 26 has reached the constant speed after the second acceleration, so that damages to the photoconductive drum can be minimized.

Fourth Embodiment

A fourth embodiment differs from the first to third embodiments in that the memory la for storing the rotational direction of the motor (i.e., the position of the planetary gear) takes the form of a non-volatile memory that can be rewritten or a memory that can be backed up by a built-in battery.

The first to third embodiments cannot detect the position of the planetary gear 25*g* until the motor 26 is rotated immediately after the printer is turned on. In the fourth embodiment, the non-volatile memory holds the data that describes the rotational direction of the motor 26, thereby detecting the correct position of the planetary gear 25*g*.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A method of controllably driving an electrophotographic printing mechanism which is controlled by a printer controller by using a planetary gear driven in rotation by a drive source, wherein the planetary gear is switched in its axial position to a first position relative to gears in mesh with the planetary gear and rotated in a first direction at the first position during a warm-up operation of the printing mechanism, and the planetary gear is switched in its axial position to a second position relative to the gears in mesh with the planetary gear and rotated in a second direction at the second position during a printing operation, the planetary gear transmitting a drive force to a first gear train during the warm-up operation and to both a second gear train and the first gear train during the printing operation, the method including the steps of:

storing first information indicative of the first position into a memory when the planetary gear stops rotating at the first position, and second information indicative of the second position into the memory when the planetary gear stops rotating at the second position;

determining whether the planetary gear should be switched from one of the first position and the second position to the other of the first position and the second position in accordance with either the first information or the second information stored in the memory and a direction of rotation in which the planetary gear should start rotating; and applying a high voltage to the printing mechanism at a first timing, the first timing being set if the planetary gear should not be switched from one of the first position and the second position to the other of the first position and the second position, and applying the high voltage to the printing mechanism at a second timing, the second timing being set if the planetary gear should be switched from one of the first position and the second position to the other of the first position and the second position.

2. The method according to claim 1, wherein if either the first information is in the memory and the planetary gear should start rotating in the first direction, or the second information is in the memory and the planetary gear should start rotating in the second direction, then the high voltage is applied to the printing mechanism at the first timing; and wherein if either the first information is in the memory and the planetary gear should start rotating in the second direction, or the second information is in the memory and the planetary gear should start rotating in the first direction, then the high voltage is applied to the printing mechanism at the second timing.

3. The method according to claim 1, wherein the drive source rotates at either a first speed or a second speed in accordance with either the first information or the second information stored in the memory and the direction of rotation in which the planetary gear should start rotating, the second speed being higher than the first speed.

4. The method according to claim 3, wherein if either the first information is in the memory and the planetary gear should start rotating in the second direction or the second information is in the memory and the planetary gear should start rotating in the first direction, then the planetary gear is switched and said printer controller causes the drive source to rotate at the first speed;

wherein if either the first information is in the memory and the planetary gear should start rotating in the first direction or the second information is in the memory and the planetary gear should start rotating in the second direction, then the planetary gear should not be switched and said printer controller causes the drive source to rotate at the second speed.

5. The method according to claim 4, wherein the drive source is switched to the second speed a predetermined time after the drive source has started rotating at the first speed.

6. The method according to claim 5, wherein the first timing is a timing after the drive source begins to rotate at the second speed when the planetary gear should not be switched in its axial position;

wherein the second timing is after the drive source begins to rotate at the first speed and is then switched to the second speed a predetermined length of time after the drive source has begun to rotate at the first speed, if the planetary gear should be switched in its axial position.

7. The method according to claim 1, wherein the high voltage is supplied from either a constant-voltage source or a constant-current source.

8. The method according to claim 7, wherein the drive source reaches a constant speed before the printing mechanism receives the high voltage from the constant-current source.

9. The method according to claim 7, wherein the drive source rotates at either a first speed or a second speed in accordance with either the first information or the second information stored in the memory and the direction of rotation in which the planetary gear should start rotating, the second speed being higher than the first speed.

10. The method according to claim 9, wherein the first timing is a timing in a time period during which the drive source is accelerated toward the second speed after the drive source begins to rotate, and the second timing is a timing in a time period during which the drive source is accelerated toward the second speed after the drive source has been switched to the second speed a predetermined time after the drive source begins to rotate at the first speed.

11. The method according to claim 10, wherein the drive source reaches the second speed before the printing mechanism receives the high voltage from the constant-current source.

12. The method according to claim 1, wherein the planetary gear should not be switched in its axial position if either the first information is in the memory and the planetary gear should start rotating in the first direction or the second information is in the memory and the planetary gear should start rotating in the second direction; and wherein the planetary gear should be switched in its axial position if either the first information is in the memory and the planetary gear should start rotating in the second direction or the second information is in the memory and the planetary gear should start rotating in the first direction.

13. The method according to claim 1, wherein the first timing is a timing in a time period after the drive source begins to rotate and before the drive source reaches a constant speed, and the second timing is a timing after the drive source has reached the constant speed.

14. The method according to claim 1, further including causing the planetary gear to transmit the drive force to the first gear train to drive in rotation the printing mechanism that includes a photoconductor, a charging section, and a developing section; and causing the planetary gear to transmit the drive force to the second gear train to drive in rotation the printing mechanism and a medium-transporting section that transports a print medium.

15. The method according to claim 14, further including causing the planetary gear to transmit the drive force through the first gear train from the drive source to the printing mechanism during the warm-up operation; and causing the planetary gear to transmit the drive force through the second gear train from the drive source to the printing mechanism and the medium-transporting section.

16. The method according to claim 15, wherein the high voltage is applied to the charging section.

* * * * *